US005416795A

United States Patent [19]

Kaniuk et al.

[11] Patent Number: 5,416,795

[45] Date of Patent: May 16, 1995

[54] QUICK CHANGE CRUCIBLE FOR VACUUM MELTING FURNACE

[76] Inventors: John A. Kaniuk, 168 Lucky Bell La., Chagrin Falls, Ohio 44023; Crispino DiRuggiero, 1712 Longwood Dr., Mayfield Heights, Ohio 44124; Donald K. Ratcliffe, 6465 Creekside Dr., Solon, Ohio 44139

[21] Appl. No.: 247,004

[22] Filed: May 20, 1994

[51] Int. Cl.[6] ..... H05B 6/22

[52] U.S. Cl. ..... 373/155; 373/151; 264/60; 432/156

[58] Field of Search ..... 373/151, 155, 156; 264/60, 220; 432/156–158

[56] References Cited

U.S. PATENT DOCUMENTS 3,401,227 9/1968 Dunlevy et al. ..... 373/156
3,708,600 1/1973 Nickel et al. ..... 373/155
3,751,571 8/1973 Burrows ..... 373/156
4,160,796 7/1979 Lirones ..... 264/60
4,351,058 9/1982 Florian et al. ..... 264/60

*Primary Examiner*—Bruce A. Reynolds
*Assistant Examiner*—Tu Hoang

[57] ABSTRACT

A crucible assembly for use in induction melting furnaces utilizes an inner crucible formed of partially stabilized zirconia and an outer support member formed of a sintered alumina. The crucibles are in the shape of a cylinder with a closed bottom wall and in the cylindrical wall area, the inner crucible and the outer support member are separated by a layer of porous ceramic fibers of alumina and silica and the entire assembly has been centered as a unit so that the outer support member with a porous layer allows for the thermal expansion and contraction of the inner crucible while limiting any stresses applied to the inner crucible and providing additional strength and support for the inner crucible.

15 Claims, 1 Drawing Sheet

Fig.1
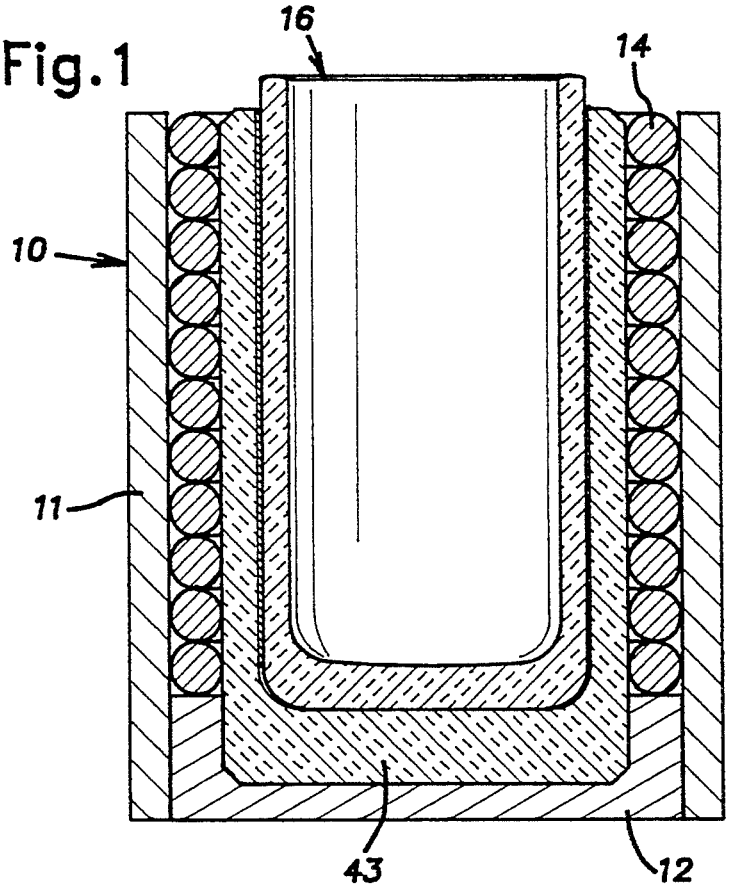
Fig.2
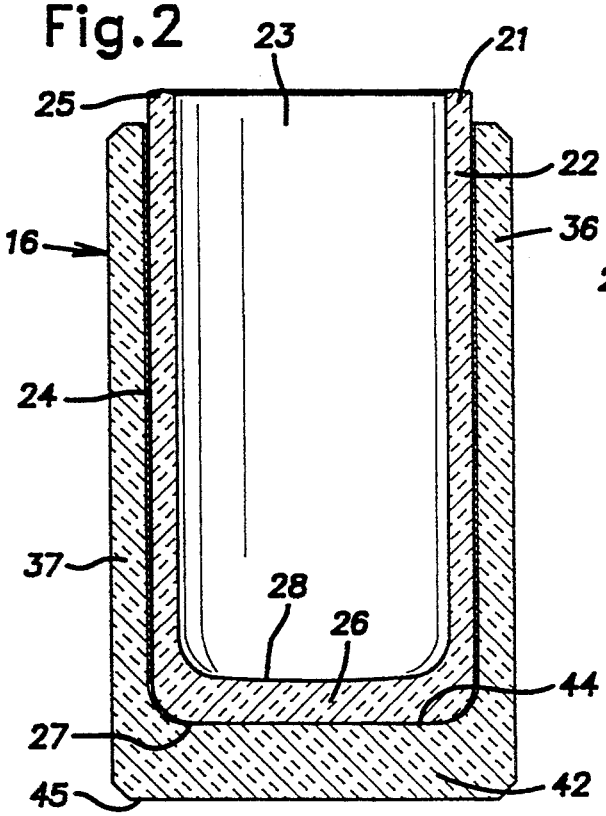
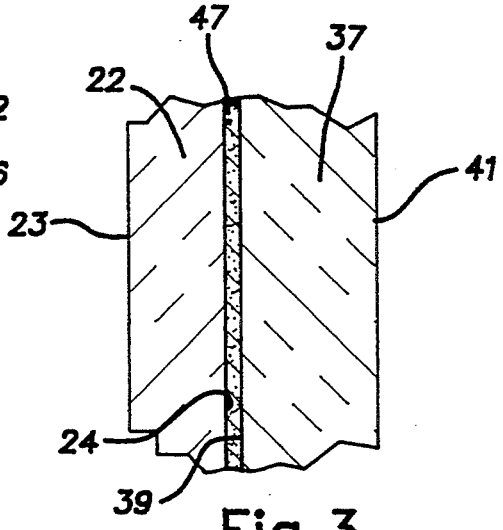
Fig.3

QUICK CHANGE CRUCIBLE FOR VACUUM MELTING FURNACE

BACKGROUND OF THE INVENTION

This invention relates generally to ceramic crucibles and more particularly to zirconia crucibles used in vacuum induction furnaces for melting refractory metals.

Vacuum electric induction furnaces are usually used for the melting and casting of special metals and alloys which require a high temperature and inert conditions to preserve the purity of the metal. Such metals are refractory super alloys which are nickel or cobalt based or precious metals such as platinum. These metals are generally melted in small quantities using electric induction coils as the heat source, since the induction process heats only the metal itself and any heating of the containing crucible is by conduction from the molten metal.

Furnaces of this type usually use a dual vacuum chamber construction with an upper melting chamber and a lower mold chamber which are separated by an interlock door. This door is closed while the charge in the crucible is being heated to allow mold assemblies to be replaced. When the melting is complete, the interlock door is opened, the mold assembly raised to a charging position, and the crucible assembly tilted toward a horizontal position to pour the contents into the mold assembly. After the pour is completed, the mold assembly is lowered and the interlock door closed. The crucible is then refilled with a billet through a billet charging door from a billet chamber, which is also under vacuum conditions, after which the crucible assembly is returned to a vertical position and the new billet melted.

During the cycle only the mold chamber and the billet chamber require cycling of the atmosphere to draw a new vacuum each time. The melt chamber remains essentially at vacuum during the whole cycle except for any leakage. However, periodically it is necessary to replace the crucible, and this has heretofore required the shutting down of the operation, and the introduction of the atmosphere into the melting chamber.

These furnaces have usually used crucibles having at least a liner made of zirconium oxide stabilized by a small addition of magnesium oxide or calcium oxide because of its highly desirable properties including its resistance to erosion, non-wetting by the molten metal, resistance to thermal shock, and low thermal conductivity. However, such crucibles are of relatively thin wall thickness because increasing the wall thickness tends to shorten the life of the crucible since thick walls tend to crack under the thermal cycling inherent in the melting process as the relatively cold billet is heated to the melting temperature.

Because of this limitation on the wall thickness, it has been necessary to provide a physical support of the crucible which is employed only as a relatively thin liner supported by a packing of crushed ceramic material such as granular aluminum oxide or granular zirconium oxide around the zirconia crucible and contained within an outer support made of a less refractory material such as a cement or insulating material. The replacement of a crucible liner with this construction has required the shutting down of the vacuum furnace and the removal of the crucible assembly. When this is done, the old crucible is removed together with the packing material which being loose granular material results is a difficult operation which is complicated by the replacement of the same construction. Also, the granular material is undesirable due to dusting problems, which can be a health hazard. This has meant that whenever it has been necessary to replace the crucible liner during operation of the furnace, the entire furnace operation must be shut down and placed out of production for an undesirable period of time. As an example, during production runs a melting cycle from pour to pour may take only about six to eight minutes, and assuming that a crucible liner has a life of 60 to 90 cycles, the crucible liner must be replaced every six to twelve hours. It can therefore be seen that an extended down time for the replacement of the crucible liner can cause a significant reduction in productivity for the furnace.

It has been recognized that the down time for liner replacement is caused primarily by the need for the use of the granular material for the crucible support. If the packing material could be combined with the liner as a package, the time for liner replacement could be greatly reduced. It has been proposed that instead of using loose granular material, a supporting capsule of castable ceramic such as aluminum silicate or oxide could be cast around the liner as a wet slurry, then dried and fired at a high temperature to form a unitary structure which could then be easily used to replace the existing structure within the induction coils. Such an arrangement has been disclosed in U.S. Pat. No. 4,160,796 granted Jul. 10, 1979. However, such an arrangement has not met with commercial success, apparently because the resultant structure did not have the required resistance to thermal shock under actual operating conditions to provide a significant improvement in the overall operation of the furnace.

SUMMARY OF THE INVENTION

According to the preferred embodiment of this invention, the crucible and a backup support are made as a unit or assembly for easy and rapid removal out of and insertion into a tiltable induction heating furnace inside the induction coils. Since both the inner crucible and the outer backup support are one piece, they can be sized to be a relatively loose fit within the induction coils and the support frame. This allows quick and easy removal and replacement without destroying the vacuum within the melting chamber. When it is deemed necessary to replace the crucible because of wear and erosion of the inner surface of the crucible liner after a number of heats, the furnace, which has previously been tilted only slightly past horizontal during pouring is then tilted further after the mold has been removed. The crucible assembly is such a loose fit within the induction coils that it can merely slide out of the coils and drop into the mold chamber for further disposal.

To insert the new crucible assembly, it is placed in the billet chamber, and after the furnace has been returned to the horizontal position, the new crucible assembly is then pushed into the coils using the billet pusher. After this, a new billet is pushed into the new crucible and the furnace tilted to the upright position to start a new heat. Since the above steps can be done using the existing apparatus of the furnace system, it can be done quickly and without necessarily breaking the vacuum in the melting chamber.

This easy replacement of the crucible assembly is possible because the backup or support for the crucible liner has been made an integral part of the crucible itself. According to the present invention, the support is cast around the crucible, but at the side wall area where the greatest heat transfer takes place, the support is spaced from the crucible liner by a thin layer of porous ceramic fibers. This layer allows thermal expansion and contraction of both the crucible liner and the outer backup or support with a minimal transfer of thermal stresses between the two members.

According to the present invention the crucible assembly is made by first making the inner crucible or liner in the usual manner. The preferred material for this liner is granular zirconia ($ZrO_2$) stabilized by about 2% to 3% of magnesium oxide (MgO), although other stabilizers such as calcium oxide (CaO) or yttrium oxide ($Y_2O_3$) can be used, depending on the particular application. This material is then pressed in a mold under high pressure to minimize porosity and provide high density. The crucible is then fired at a high temperature in excess of 1600° C. to form a sintered product with all of the desirable properties of zirconia.

After the crucible has cooled, the cylindrical side wall is covered with a layer of ceramic fiber paper which preferably does not extend over the bottom wall. The paper is held in place by suitable tape, and the crucible is inverted and placed in a mold into which is poured a castable wet slurry of aluminum oxide ($Al_2O_3$) particles to cover the ceramic fiber paper and the bottom wall of the crucible to form the size and shape of the finished crucible assembly. After the assembly has dried and been removed from the mold, it is fired at a high enough temperature to drive off any organic materials and produce the finished assembly.

BRIEF DESCRIPTION OF THE DRAWINGS

FIG. 1 is a vertical cross section of an induction melting furnace incorporating the crucible assembly of the present invention;

FIG. 2 is a cross section through the crucible assembly itself; and

FIG. 3 is an enlarged cross section in detail of the crucible assembly wall.

DETAILED DESCRIPTION OF THE PREFERRED EMBODIMENT

Referring to the drawings in greater detail, FIG. 1 is a schematic showing of a furnace assembly 10 to which the present invention is applicable. As shown, the furnace assembly 10 includes a side member 11 and a bottom member 12 formed of appropriate heat insulating and non-metallic material providing the frame of the furnace assembly 10. Within the side member 11 are mounted induction coils 14 and a crucible assembly 15 fits within the coils 14 and is supported on the bottom member 12. These latter members are shown for purposes of illustration only since the present invention resides entirely in the crucible assembly 16 and not in the supporting and ancillary structure.

The crucible assembly 16 includes an inner crucible 21 having a cylindrical wall 22 with an inner surface 23 and an outer surface 24. The upper end of the cylindrical wall 22 is rounded to form a pouring lip 25 while at the other end the crucible has a bottom wall 26 which blends into the cylindrical wall 22. The bottom wall 26 has a flat outer surface 27 and an inner surface 28 which may be either flat or rounded as desired. The crucible 21 is preferably formed from magnesium oxide stabilized zirconia having 95% to 97% $ZrO_2$ and preferable 95.4% $ZrO_2$, with 2–4% MgO and preferable 2.2% MgO with the remainder being $SiO_2$, with $Al_2O_3$ and other impurities, although other stabilizers such as CaO and $Y_2O_3$ can be used. The crucible is made by high pressure forming course grain zirconia granules by forcing them under high pressure against a smooth mandrel shaped in accordance with the interior of the crucible. The crucible is then fired at around 1600° C.–1700° C. The result is an inner crucible having the best properties of zirconia and a smooth inner surface that is erosion resistance and non-wetting. The amount of stabilization of the zirconia in these crucibles is chosen in a range of 40%–75% to give the best combination of strength and resistance to thermal shock. However, to obtain these properties, the wall thickness must necessarily remain relatively thin so that the crucible requires external support in use so that it can be easily handled and tipped for pouring purposes. For this reason, prior use of these crucibles has generally required that they be placed inside an outer support leaving a clearance space around the crucible. This clearance space has been packed with granular ceramic material, such as aluminum oxide or silicate and is generally hand packed and rammed in place. This crushed support material is tight enough to provide support of the zirconia inner crucible but is not sufficiently tight that it prevents the necessary thermal expansion of the inner crucible as it is alternately heated during the induction melting process and cooled during the introduction of a new billet to be melted. While this aforesaid method of supporting the crucible in the induction furnace has been satisfactory under melting operations, it is resulted in an extended period of down time when it has been found necessary to replace the inner crucible.

According to the present invention, support is provided by an outer crucible support 36 having a cylindrical side wall 37 terminating in a top edge 38 and defining an inner surface 39. The crucible support 36 has an outer surface 41 adapted to fit within the induction coils 14 and a bottom wall 43 adapted to fit within the furnace bottom member 12. This bottom wall 43 has an inner surface 44 and an outer surface 45 adapted to make a close fit with the bottom member 12 although loose enough that the crucible assembly 16 can move in and out of the furnace assembly 10 under the weight of gravity.

According to the present invention, the inner crucible 21 and the crucible support 36 are spaced from each other along the side walls 22 and 37 by means of a porous layer 47 formed of ceramic fibers such as silica, silica and alumina, zircon or zirconia. A suitable product is a ceramic fiber paper sold under the name "INSWOOL" by AP Green Refractories of Mexico, Mo. This ceramic fiber paper is formed from alumina-silica ceramic fibers having about 46% to 49% $Al_2O_3$ and 50% to 53% $SiO_2$ formed into a flexible sheet and held by a minor amount of an organic binder. This ceramic fiber paper can have a thickness between 0.25 mm and 1.5 mm and preferably is used in a thickness of a nominal 0.8 mm and is cut to extend around the crucible cylindrical outer wall 24 without overlapping and the ends can be held together by a suitable tape such as masking tape on a temporary basis.

To form the crucible support and hence a complete crucible assembly 16, the inner crucible 21 with the fiber paper applied is inverted in a mold having a diameter corresponding to the outer surface 41, with the pouring lip 25 of the inner crucible placed inside a rubber ring to insure that the material for the crucible support does not get too close to the pouring lip 25. The space between the porous paper layer 47 and the wall of the mold is then filled by a castable alumina or aluminum-oxide material which is mixed with just enough water to allow it to flow into and around the inner crucible using vibration to insure complete filling. This material is chosen to have a low shrinkage when sintered at a high temperature and should be less than 0.5% when heated to 1400° C. A suitable alumina castable is sold under the name of "HP-CAST ULTRA" by North American Refractories Corporation and consists generally of at least 96% $Al_2O_3$. The castable material is allowed to set at room temperature for at lest 8 hours or until it is strong enough to stand by itself after removal from the mold. The assembly is then dried at a temperature in the range of 65° C.–95° C. for a period of 24–48 hours or until substantially all moisture has been removed. The entire assembly is then fired and sintered at a temperature of about 950° C.–1000° C. for a period of about 2 hours to result in the finished crucible assembly.

The assembly will then have a smooth zirconia inner crucible having all of the desirable properties of these units in the past. The outer support crucible of aluminum-oxide refractory then has a relatively smooth surface from the mold in which it is cast and this is of such a size that it can move easily in and out of the induction coils and other structural members of the furnace assembly as a unit. The porous layer of ceramic paper between the inner crucible and the outer support, the organic materials having been burned away during the firing, adheres to both the inner crucible and the outer support to hold them together as a unit. This layer provides a somewhat porous gap partially filled by the fibers but with sufficient space to allow for differential thermal expansion and contraction between the inner crucible and the outer support while the outer support is strong enough and rigid enough to provide the support that used to be provided by the granular packing material in the prior art arrangement. The finished crucible assembly is then easily removed and replaced in the furnace assembly by the force of gravity.

As an example, with one size of crucible assembly, the overall diameter of the support side wall 37 is about 160 mm with a total height of about 280 mm. The outside diameter of the inner crucible, that is the diameter of cylindrical wall 22 and its outer surface 24 is about 127 mm with a wall thickness of about 10 mm. With the thickness of the porous fiber layer 47 being approximately 1 mm or slightly more, the wall thickness of the crucible support 36 is about 15 mm.

It is to be noted that the porous fiber layer extends only over the sidewalls of the inner crucible and not over the outer bottom wall surface 27 which is therefore in direct contact with the inner surface 44 of crucible support bottom wall 43. Although a porous layer could be used in this area, it has not been found necessary since the bottom walls do not get heated as much by the molten charge within the crucible for as long a time since the crucible bottom wall is in contact with molten metal only after the metal turns into a molten state and the contact between the solid metal and the bottom wall is insufficient to transfer much heat to the bottom wall.

Although the preferred embodiment of the invention has been shown and described, it is recognized that various modifications and rearrangements may be resorted to without departing from the scope of the invention as defined in the claims.

We claim:

1. A crucible assembly for an induction furnace comprising an inner crucible formed from a first ceramic material and having a cylindrical side wall, a closed bottom wall extending across one end of said side wall, the other end of said crucible being open, a layer of porous fibers of a second ceramic material extending over the outer surface of said cylindrical side wall, and an outer support member formed from a third ceramic material extending over said closed bottom wall and said porous fibers layer.

2. A crucible assembly as set forth in claim 1, wherein said inner crucible, said layer of porous fibers and said support member have been centered as a unit.

3. A crucible assembly as set forth in claim 2, wherein said inner crucible consists essentially of partially stabilized zirconia.

4. A crucible assembly as set forth in claim 3, wherein said zirconia is stabilized by magnesium oxide.

5. A crucible assembly as set forth in claim 3, wherein said outer support member comprises a material that shrinks less than 0.5% when heated to 1400° C.

6. A crucible assembly as set forth in claim 3, wherein said outer support member consists essentially of alumina.

7. A crucible assembly as set forth in claim 3, wherein said porous fibers consist essentially of alumina and silica.

8. A crucible assembly as set forth in claim 3, wherein said porous fibers consist essentially of silica.

9. A crucible assembly as set forth in claim 3, wherein said porous fibers consist essentially of zircon.

10. A crucible assembly as set forth in claim 3, wherein said porous fibers consist essentially of zirconia.

11. A crucible assembly as set forth in claim 7, wherein said alumina is present in the range of 46%–49% and said silica is present in the range of 50%–53%.

12. The method of manufacturing a crucible assembly for use in an induction melting furnace having induction coils surrounding said crucible assembly comprising the steps of forming an inner crucible by pressing ceramic particles in a mold, said inner crucible having a cylindrical side wall and a closed bottom wall, firing said inner crucible at a first temperature to produce a finished sintered crucible, thereafter covering said cylindrical side wall with a porous layer of ceramic fibers, thereafter pouring a castable ceramic around said sintered crucible in a mold to cover said porous layer and said bottom wall, allowing said castable ceramic to set and dry, and thereafter firing said crucible assembly at a second temperature to produce a unitary crucible assembly.

13. The method as set forth in claim 12, wherein said first temperatures in the range of 1600° C. to 1700° C.

14. The method as set forth in claim 12, wherein said second temperatures in the range of 950° C.–1000° C.

15. The method as set forth in claim 12, wherein said porous layer has a thickness between 0.25 mm. and 1.5 mm.

* * * * *

UNITED STATES PATENT AND TRADEMARK OFFICE

CERTIFICATE OF CORRECTION

PATENT NO. : 5,416,795

DATED : May 16, 1995

INVENTOR(S) : Kaniuk et al

It is certified that error appears in the above-indentified patent and that said Letters Patent is hereby corrected as shown below:

Column 6, line 22, after "is" insert —partially—.

Signed and Sealed this

Twenty-eighth Day of November 1995

*Attest:*

BRUCE LEHMAN

*Attesting Officer*

*Commissioner of Patents and Trademarks*